US006871406B1

(12) United States Patent
Elia et al.

(10) Patent No.: US 6,871,406 B1
(45) Date of Patent: Mar. 29, 2005

(54) PROTECTIVE MEMBER FOR COMPASS PINS

(76) Inventors: Sal Robert Elia, 9625 Elizabeth Lake Rd., Leona Valley, CA (US) 93551; Lori Jean Banton, 5025 Benedict Ct., Oak Park, CA (US) 91377

( * ) Notice: Subject to any disclaimer, the term of this patent is extended or adjusted under 35 U.S.C. 154(b) by 0 days.

(21) Appl. No.: 10/692,695

(22) Filed: Oct. 27, 2003

(51) Int. Cl.[7] ..... B43L 9/02; B43L 9/16
(52) U.S. Cl. ..... 33/27.02
(58) Field of Search ..... 33/27.02, 27.03, 33/27.031, 27.032, 27.033

(56) References Cited

U.S. PATENT DOCUMENTS

| | | | | |
|---|---|---|---|---|
| 341,081 A | | 5/1886 | Weissenborn | |
| 1,292,086 A | * | 1/1919 | Schenck | 33/27.02 |
| 2,017,737 A | * | 10/1935 | Smith | 33/27.02 |
| 2,442,185 A | * | 5/1948 | Szerenyl | 33/27.02 |
| 2,454,305 A | * | 11/1948 | Cameron | 33/27.02 |
| 2,718,703 A | | 9/1955 | Chilcote | |
| 2,745,181 A | * | 5/1956 | Czerniewicz | 33/27.03 |
| 2,809,437 A | * | 10/1957 | Kuzma | 33/27.02 |
| 2,827,701 A | * | 3/1958 | Goehring | 33/27.03 |
| 3,237,308 A | * | 3/1966 | Dorstewitz | 33/27.02 |
| 3,394,460 A | * | 7/1968 | Stein et al. | 33/27.02 |
| 3,537,181 A | * | 11/1970 | Graef | 33/27.02 |
| 4,616,418 A | | 10/1986 | Wade, III | |
| 6,311,404 B1 | | 11/2001 | Smith | |
| 6,546,634 B2 | * | 4/2003 | Ming | 33/27.032 |

FOREIGN PATENT DOCUMENTS

JP 10193877 A2 7/1998

* cited by examiner

*Primary Examiner*—G. Bradley Bennett
(74) *Attorney, Agent, or Firm*—Stites & Harbison PLLC; Ross F. Hunt, Jr.

(57) ABSTRACT

A protective member is provided for a compass device including two pivotably connected legs wherein one leg has a distal end including a projecting pin. This end also includes matching elongate slots in opposed surfaces and matching spaced grooves formed in these opposed surfaces at an upper distal portion. The member includes spaced side wall joined by an orthogonal wall. The side walls include internal shoulders at one end and internal, oppositely projecting lugs. The lugs are received in the slots in the one leg to able movement of the member between one end of the slots wherein the member is maintained in an inoperative position, and a second end wherein the member is disposed in an intermediate position. The member is pivotable about the lugs in to an operative position wherein the pin is shielded by the member.

22 Claims, 4 Drawing Sheets

PROTECTIVE MEMBER FOR COMPASS PINS

FIELD OF THE INVENTION

The present invention relates to drawing instruments such as compasses wherein the instrument is rotated around a pin or other element with a pointed end and, more particularly, to a protective device for the pin of such instruments.

BACKGROUND OF THE INVENTION

As is well known, one form of conventional compass includes a pin or the like at the distal end of one of the legs thereof which serves as a pivot point about which the other, marking leg rotates during use of the compass. The sharp pointed end of the pin of a compass presents an obvious injury hazard, and a number of approaches have been taken in providing a protective covering or shield for the sharp end, including simple thimble-like covers.

Other protective devices for this purpose are more complex, and patents of interest in this field include the following: Japanese Patent No. JP 10193877A2 to Yamazaki; U.S. Pat. No. 341,081 to Weissenborn, U.S. Pat. No. 2,718,703 to Chilcote; U.S. Pat. No. 4,616,418 to Wade, III; and U.S. Pat. No. 6,311,404 to Smith.

Briefly considering these patents, the Yamazaki patent application discloses a drawing compass having a pivotable protective cover member for concealing the tip of the pin. The Weissenborn patent discloses a compass having two sharp points. A rubber casing protector having a pair of slits is provided and the sharp points of the compass are inserted into the rubber casing, via the slits, so as to protect the points of the compass and prevent injury to a user of the compass. The Chilcote patent discloses a compass protector which includes a guard device for receiving the sharp point of the compass when the compass is not in use so as to protect the user against injury. The Wade, III patent discloses a beam compass having exchangeable parts for making drawings on a variety of surfaces. A marker carrier is adapted to receive a large marker such as a felt-tip pen while a chuck receives smaller diameter markers such as crayons or chalk. When a needle is employed, a slidable guard can be used to selectively cover the needle. The Smith patent discloses a compass assembly having a removable marking device attached to one of two legs. A second leg contains a retractable sleeve including a spring and engaging pin therein. In use, pressure applied to the second leg pushes the engaging pin through a hole in the retractable sleeve and thus anchors the compass. A sleeve is provided to encase the pointed end of the pin when the pin is not in use.

SUMMARY OF THE INVENTION

In accordance with the invention, a protective member is provided for covering or shielding the sharp pins of compass devices, and the like which provides important advantages over the prior art. The protective member, in combination with the cooperating construction of the leg on which the pin is mounted, enable the member to be readily moved between the operative and inoperative positions thereof. No springs or other elements are required as in some of the devices discussed above, and, in this regard, the invention also eliminates the need for pivot elements such as are necessary with others of the above-described devices. The protective member is disposed essentially flush with the corresponding compass leg in the inoperative position thereof and is unobtrusive in the operative position thereof. In addition, the member, which is preferably made of plastic, is extremely inexpensive, easy to make, and rugged in construction, and can be readily removed, and replaced, if necessary.

In accordance with a first aspect of the invention, there is provided, in combination, (i) a compass device including a first leg and second leg pivotably connected together wherein at least said first leg has a distal end including a pin projecting outwardly therefrom, and (ii) a protective member for said pin, the distal end of said first leg including matching elongate slots in opposed surfaces; and said protective member including spaced side walls joined by an orthogonal wall, said side walls including internal, oppositely projecting lug elements received in the slots in the distal end of said first leg so as to mount the protective member on said distal end and so as to enable movement of the protective member between an inoperative position at one end of the slots and an operative position at a second end of the slots wherein said protective member shields said pin.

Preferably, the protective member is pivotable into said operative position about said lug elements from an intermediate position thereof at the second end of the slots.

In an important implementation the distal end of the first leg further includes matched spaced grooves formed in said opposed surfaces at an upper distal portion of the distal end of the first leg adjacent to said pin, the side walls include internal shoulders at one end thereof and, in said operative position of the protective member, a part of said internal shoulders engages a portion of the distal end of said first leg defining said grooves and said pin is covered by said protective member. Preferably, the grooves each comprise a slant portion and a longitudinal portion and said shoulders include a step therein comprised of a substantially longitudinal portion and a substantially transverse portion. Advantageously, in said inoperative position of said protective member, said longitudinal portion of each of said internal shoulders of said protective member engages a respective part of said distal end defining said slant portion of said grooves to assist in retaining said protective member in said inoperative position.

Preferably, the protective member includes a notch in one end of said orthogonal wall in which, in use, said pin is received so as to be partially surrounded by portions of said one end defining said notch. Advantageously, the protective member further includes a slot in said one end for assisting in enabling the protective member to be mounted on, and removed from, said first leg, said slot comprising said notch, an aperture, and a slit connecting said notch to said aperture.

More generally, the protective member preferably includes slot means therein for assisting in enabling the protective member to be mounted on, and removed from, said first leg. Advantageously, the protective member is made of a flexible plastic.

Advantageously, the orthogonal wall of said protective member includes at least one raised gripping portion.

In a preferred embodiment, the protective member comprises a flexible plastic permitting said member to be mounted on, and removed from, said first leg by inserting said lug elements into said slots, and withdrawing said lug elements from said slots, respectively.

Advantageously, the orthogonal wall is curved at one end thereof and includes a tail portion at an opposite end thereof extending beyond said side walls.

In accordance with a further aspect of the invention, there is provided, in combination, (i) a compass device including a first leg and second leg pivotably connected together wherein at least said first leg has a distal end including a pin projecting outwardly therefrom, and (ii) a protective member for said pin, the distal end of said first leg of the compass device including matching elongate slots in opposed surfaces thereof and matching spaced grooves formed in said opposed surfaces at a upper distal portion of the distal end of the first leg adjacent to said pin; and the protective member including spaced side walls joined at one edge by a further wall, said side walls including internal shoulders at one end thereof and further including, spaced from said internal shoulders, internal, oppositely projecting lug elements, said lug elements being received in the slots in the distal end of said first leg so as to mount the protective member on said distal end and so as to enable the protective member to move between one end of the slots wherein a proximal portion of said internal shoulders abuts a proximal portion of said grooves and said protective member is maintained in a first, inoperative position and a second end of the slots wherein said protective member is disposed in a second, intermediate position thereof at least partially covering said pin, said protective member being pivotable about said lug elements in said second, intermediate position thereof to a third, operative position wherein a part of said internal shoulders engages a portion of the distal end of said first leg defining said grooves and wherein said pin is covered by said protective member.

As above, the grooves preferably each comprise a slant portion and a longitudinal portion and said shoulders include a step therein comprised of a substantially longitudinal portion and a substantially transverse portion. Further, in a preferred embodiment, in said inoperative position of said protective member, said longitudinal portion of said internal shoulders of said protective member engages a respective part of said distal end defining said slant portion of said grooves to assist in retaining said protective member in said inoperative position.

Advantageously, the protective member includes a notch in one end of said further wall in which, in use, said pin is received so as to be partially surrounded by portions of said one end defining said notch. Preferably, the protective member further includes a slot in said one end of said further wall for assisting in enabling the protective member to be mounted on, and removed from, said first leg, said slot comprising said notch, an aperture, and a slit connecting said notch to said aperture.

As above, and more generally, the protective member preferably includes slot means therein for assisting in enabling the protective member to be mounted on, and removed from, said first leg.

In a preferred implementation, the protective member is made of a flexible plastic.

Advantageously, the further wall of said protective member includes at least one raised gripping portion.

The protective member preferably comprises a flexible plastic permitting said member to be mounted on, and removed from, said first leg by inserting said lug elements into said slots, and withdrawing said lug elements from said slots, respectively.

As above, the further wall is advantageously, curved at one end thereof and includes a tail portion at an opposite end thereof extending beyond said side walls.

Further features and advantages of the present invention will be set forth in, or apparent from, the detailed description of preferred embodiments thereof which follows.

DESCRIPTION OF THE PREFERRED EMBODIMENTS

Figure 1:
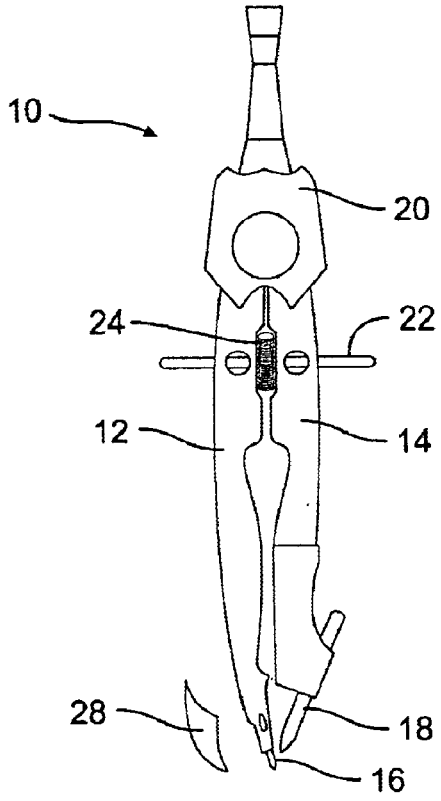
FIG. 1 is a front elevational view of a compass device, adapted to incorporate a protective device in accordance with the invention, with the protective device being shown separated from the compass device.

Referring to FIG. 1, there is shown a compass device which is generally denoted 10. In brief, compass device 10 includes first and second legs 12 and 14 pivotably connected to each other. Leg 12 includes a pin 16 (or other element including a sharpened end point) while leg 14 is adapted to carry a marking element indicated at 18. Legs 12 and 14 pivot about a pivot point (not shown) which is located within an upper housing 20 which houses the proximal ends of legs 12 and 14. In the embodiment illustrated, a transverse screw 22 carrying a central control wheel 24 extends through an upper intermediate portion of both legs 12 and 14. The legs 12 and 14 are each mounted on screw 22 in the manner of a traveling nut such that rotation of control wheel 24 in one direction causes the legs 12 and 14 to pivot away from each other, while rotation of control wheel 24 in the opposite direction causes the legs 12 and 14 to pivot towards each other to the closely adjacent end positions shown in FIG. 1.

It is to be understood that while the compass device 10 of FIG. 1 has been briefly described above so as to identify basic components thereof, the present invention is applicable to other, conventional compass devices, including, for example, those shown and described in the Weissenborn, Smith and Chilcote patents discussed above, and, in general, is applicable to any compass or like device including a pin and other pointed element at end thereof.

Figure 2:
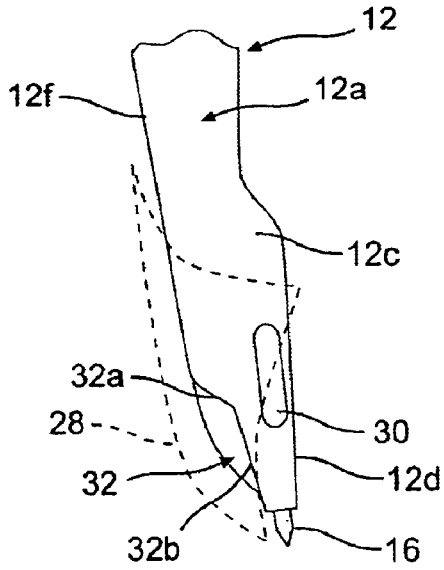
FIG. 2 is a front elevational view, to an enlarged scale, of a portion of one of the legs of FIG. 1, showing the protective member in dashed lines.
Figure 3:
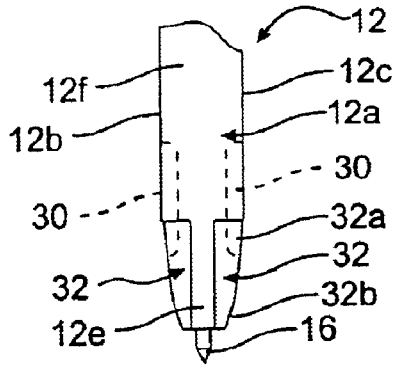
FIG. 3 is a top plan view of the leg portion shown in FIG. 2.
Figure 4:
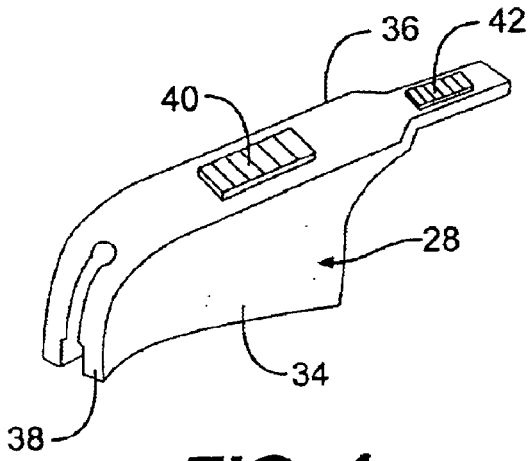
FIG. 4 is a perspective view of a protective member in accordance with a preferred embodiment of the invention.
Figure 5:
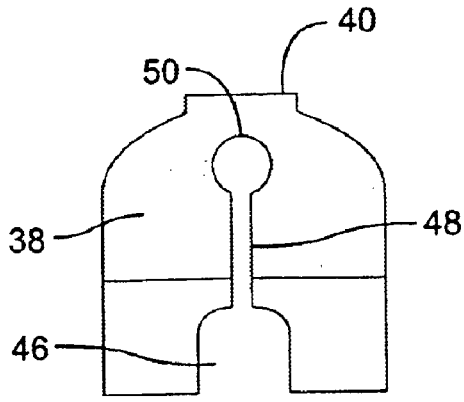
FIG. 5 is an end view of the member of FIG. 4.
Figure 6:
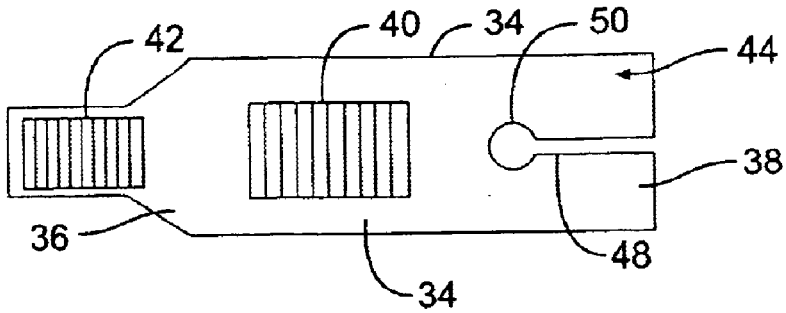
FIG. 6 is a top plan view of the member of FIG. 4.
Figure 7:
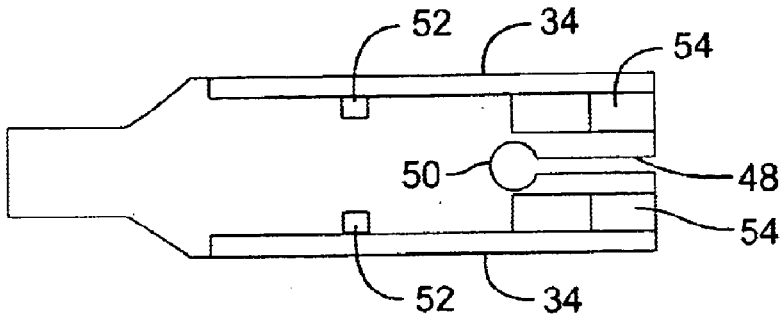
FIG. 7 is a bottom plan view of the member of FIG. 4.
Figure 8:
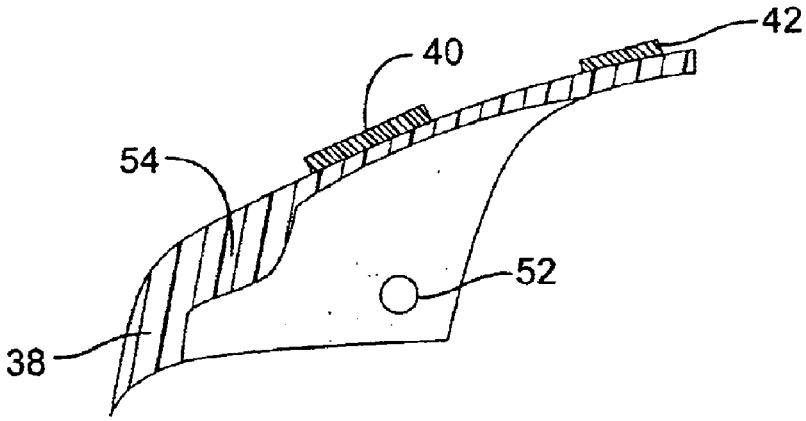
FIG. 8 is a transverse cross-sectional view of the member of FIG. 4.

Referring to FIGS. 2 and 3, an end portion 12*a* of the distal end of leg 12 of device 10 is shown, with a protective member in accordance with a preferred embodiment of the invention being indicated in dashed lines at 28 in FIG. 2. As illustrated, the end portion of leg 12 includes a pair of matched, elongated slots 30 in opposite side surfaces 12*b* and 12*c* thereof. Slots 30 both include rounded ends and extend generally parallel to, and are located adjacent to, the inner surface 12*d* of end portion 12*a*.

A pair of spaced matched grooves 32 are also provided in side surfaces 12*b* and 12*c*. Grooves 32 are spaced apart by a distal portion or island 12*e* formed at the distal end of leg 12 by the remaining portion of outer or upper surface 12*f* left when grooves 32 are provided. As illustrated, and as best seen in FIG. 2, grooves 32 include a slant or sloping part 32*a* which slants downwardly from outer or upper surface 12*f* and a longitudinal portion or flat 32*b* which extends generally parallel to the inner or lower surface 12*d*.

Referring to FIGS. 4 to 8, which show a preferred embodiment of the protective member 28, member 28 includes a pair of side walls 34, a top wall 36 and an end wall 38, with end wall 38 basically being a continuation of top wall 36, as illustrated.

Top wall 36 includes a pair of raised, longitudinally spaced, gripping portions 40 and 42, with the latter being formed on a tail portion of wall 36, as shown.

End wall 38 includes a slot 44 comprising a lower notch 46 (see FIGS. 4 and 5) connected by a longitudinal slit 48 to an upper or inwardly located aperture 50. Slot 44 enables the parts of member 28 on opposite sides thereof to be spread apart slightly so as to enable member 28 to be mounted on, and removed from, leg 12. Protective member 28 is preferably made of plastic and more preferably, of a plastic that is flexible enough to assist in the mounting and removal of member 28 just described.

Side walls 34 include opposed inwardly projecting lug elements or lugs 52 (see FIG. 7) which are adapted to be received in, and ride along, slots 30 in leg 12. As can best be seen in FIGS. 7 and 8 taken together, a pair of stepped shoulders 54 are formed at the distal end of side walls 34 which terminate at end wall 38. These shoulders 54 are adapted to engage in respective recesses 32 of leg 12, as explained below.

Figure 9:
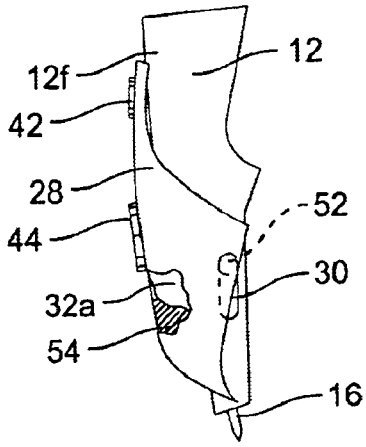
FIGS. 9 to 11 are each side elevational views of the leg end portion with the protective member mounted thereon, showing different positions of the protective member.
Figure 10:
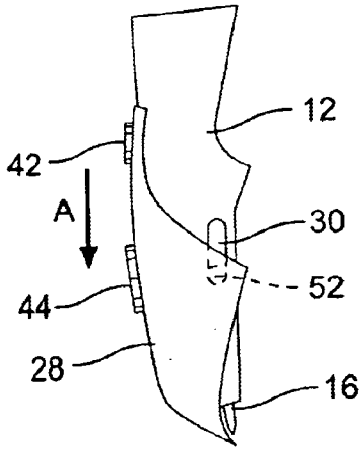
Figure 11:
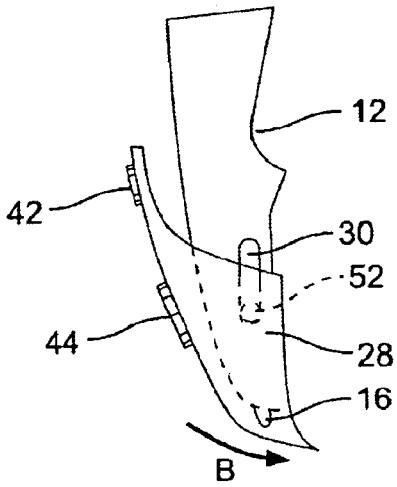

Referring to FIGS. 9 to 11, the operational movements of protective member 28 are shown. In FIG. 9, member 28 is shown in a first, inoperative position thereof wherein lugs 52 are located in slots 30 at the proximal ends thereof, and pin 16 is exposed, as shown. As Illustrated in the area of member 28 that has been broken away, in this position, the proximal shoulder portion of shoulders 54 engage the corresponding slant portions 32*a* of grooves 32, and this, together with the engagement between lug elements 52 and corresponding slots 39 serve to retain the member 28 in this end position, substantially flush with the adjacent surface 12*f* of leg 12.

FIG. 10 shows a second, intermediate position wherein member 28 is moved distally, i.e., in longitudinal or axial direction toward pin 16, as indicated by arrow A, and, as a consequence, lugs 52 are moved to the distal ends of slots 30, so that the distal end of member 28 overlies pin 16. Although in this intermediate position of member 28, pin 16 is still exposed, member 28 provides some shielding thereof, as illustrated.

Referring to FIG. 11, member 30 is then pivoted, as indicated by arrow B, around lugs 52, to a position wherein the internal shoulders 54 of member 30 engage the longitudinal portions or flats 32*b* of grooves 32. In this position, the notch 46 in member 30 at the bottom of slot 44 partially surrounds pin 16, and the distal end of member 28 extends just beyond pin 16 so as to provide complete shielding thereof.

It will be appreciated from the foregoing that the complementary, cooperating constructions of protective member 28 and the distal end 12*a* of leg 12 of compass device 10 provide complete shielding of pin 16 and that this shielding is afforded by simple movement of member 28 from the inoperative to the operative position thereof, as described above. Moreover, in the inoperative position thereof, member 28 is mounted flush with distal end 12*a* of leg 12, completely out of the way so that pin 16 can be used without interference from member 28. Member 28 is also unobtrusive in the operative position thereof. As discussed above, member 28 is the only moving part of the protective mechanism for pin 16 and no springs or the like are required.

Although the invention has been described above in relation to preferred embodiments thereof, it will be understood by those skilled in the art that variations and modifications can be effected in these preferred embodiments without departing from the scope and spirit of the invention.

What is claimed:

1. In combination, (i) a compass device including a first leg and second leg pivotably connected together wherein at least said first leg has a distal end including a pin projecting outwardly therefrom, and (ii) a protective member for said pin, the distal end of said first leg including matching elongate slots in opposed surfaces; and said protective member including spaced side walls joined by an orthogonal wall, said side walls including internal, oppositely projecting lug elements received in the slots in the distal end of said first leg so as to mount the protective member on said distal end and so as to enable movement of the protective member between an inoperative position at one end of the slots and an operative position at a second end of the slots wherein said protective member shields said pin.

2. A device as claimed in claim 1 wherein said protective member is pivotable into said operative position about said lug elements from an intermediate position thereof at the second end of the slots.

3. A device as claimed in claim 2 wherein the distal end of the first leg further includes matched spaced grooves formed in said opposed surfaces at an upper distal portion of the distal end of the first leg adjacent to said pin, wherein said side walls include internal shoulders at one end thereof and wherein, in said operative position of the protective member, a part of said internal shoulders engages a portion of the distal end of said first leg defining said grooves and said pin is covered by said protective member.

4. A device as claimed in claim 3 wherein grooves each comprise a slant portion and a longitudinal portion and said shoulders include a step therein comprised of a substantially longitudinal portion and a substantially transverse portion.

5. A device as claimed in claim 4 wherein, in said inoperative position of said protective member, said longitudinal portion of each of said internal shoulders of said protective member engages a respective part of said distal end defining said slant portion of said grooves to assist in retaining said protective member in said inoperative position.

6. A device as claimed in claim 1 wherein said protective member includes a notch in one end of said orthogonal wall in which, in use, said pin is received so as to be partially surrounded by portions of said one end defining said notch.

7. A device as claimed in claim 6 wherein said protective member further includes a slot in said one end for assisting in enabling the protective member to be mounted on, and removed from, said first leg, said slot comprising said notch, an aperture, and a slit connecting said notch to said aperture.

8. A device as claimed in claim 1 wherein said protective member includes slot means therein for assisting in enabling the protective member to be mounted on, and removed from, said first leg.

9. A device as claimed in claim 8 wherein said protective member is made of a flexible plastic.

10. A device as claimed in claim 1 wherein said orthogonal wall of said protective member includes at least one raised gripping portion.

11. A device as claimed in claim 1 wherein said protective member comprises a flexible plastic permitting said member to be mounted on, and removed from, said first leg by inserting said lug elements into said slots, and withdrawing said lug elements from said slots, respectively.

12. A device as claimed in claim 1 wherein said orthogonal wall is curved at one end thereof and includes a tail portion at an opposite end thereof extending beyond said side walls.

13. In combination, (i) a compass device including a first leg and second leg pivotably connected together wherein at least said first leg has a distal end including a pin projecting outwardly therefrom, and (ii) a protective member for said pin, the distal end of said first leg of the compass device including matching elongate slots in opposed surfaces thereof and matching spaced grooves formed in said opposed surfaces at a upper distal portion of the distal end of the first leg adjacent to said pin; and said protective member including spaced side walls joined at one edge by a further wall, said side walls including internal shoulders at one end thereof and further including, spaced from said internal shoulders, internal, oppositely projecting lug elements, said lug elements being received in the slots in the distal end of said first leg so as to mount the protective member on said distal end and so as to enable the protective member to move between one end of the slots wherein a proximal portion of said internal shoulders abuts a proximal portion of said grooves and said protective member is maintained in a first, inoperative position and a second end of the slots wherein said protective member is disposed in a second, intermediate position thereof at least partially covering said pin, said protective member being pivotable about said lug elements in said second, intermediate position thereof to a third, operative position wherein a part of said internal shoulders engages a portion of the distal end of said first leg defining said grooves and wherein said pin is covered by said protective member.

14. A device as claimed in claim 13 wherein grooves each comprise a slant portion and a longitudinal portion and said shoulders include a step therein comprised of a substantially longitudinal portion and a substantially transverse portion.

15. A device as claimed in claim 14 wherein, in said inoperative position of said protective member, said longitudinal portion of said internal shoulders of said protective member engages a respective part of said distal end defining said slant portion of said grooves to assist in retaining said protective member in said inoperative position.

16. A device as claimed in claim 13 wherein said protective member includes a notch in one end of said further wall in which, in use, said pin is received so as to be partially surrounded by portions of said one end defining said notch.

17. A device as claimed in claim 16 wherein said protective member further includes a slot in said one end of said further wall for assisting in enabling the protective member to be mounted on, and removed from, said first leg, said slot comprising said notch, an aperture, and a slit connecting said notch to said aperture.

18. A device as claimed in claim 13 wherein said protective member includes slot means therein for assisting in enabling the protective member to be mounted on, and removed from, said first leg.

19. A device as claimed in claim 18 wherein said protective member is made of a flexible plastic.

20. A device as claimed in claim 13 wherein said further wall of said protective member includes at least one raised gripping portion.

21. A device as claimed in claim 13 wherein said protective member comprises a flexible plastic permitting said member to be mounted on, and removed from, said first leg by inserting said lug elements into said slots, and withdrawing said lug elements from said slots, respectively.

22. A device as claimed in claim 13 wherein said further wall is curved at one end thereof and includes a tail portion at an opposite end thereof extending beyond said side walls.

* * * * *